US006171053B1

(12) United States Patent
Ulma

(10) Patent No.: US 6,171,053 B1
(45) Date of Patent: Jan. 9, 2001

(54) DEVICE FOR THERMALLY INSULATING A STEAM TURBINE CASING

(75) Inventor: Andreas Ulma, Mülheim an der Ruhr (DE)

(73) Assignee: Siemens Aktiengesellschaft, Munich (DE)

( * ) Notice: Under 35 U.S.C. 154(b), the term of this patent shall be extended for 0 days.

(21) Appl. No.: 09/428,579

(22) Filed: Oct. 28, 1999

Related U.S. Application Data

(63) Continuation of application No. PCT/DE98/01104, filed on Apr. 21, 1998.

(30) Foreign Application Priority Data

Apr. 28, 1997 (DE) ..... 197 17 962

(51) Int. Cl.[7] ..... F01D 25/08; F03B 11/02

(52) U.S. Cl. ..... 415/178; 415/110; 415/219.1

(58) Field of Search ..... 415/110, 111, 415/112, 170.1, 178, 182.1, 176, 203, 204, 205, 214.1, 219.1; 137/884

(56) References Cited

U.S. PATENT DOCUMENTS

| | | | | |
|---|---|---|---|---|
| 3,313,517 | | 4/1967 | Hanschke . | |
| 3,654,960 | * | 4/1972 | Kiernan | 137/884 |
| 3,680,589 | * | 8/1972 | Jeans et al. | 137/884 |
| 3,881,843 | * | 5/1975 | Meylan | 415/213.1 |
| 4,183,373 | * | 1/1980 | Kay | 137/884 X |
| 4,382,452 | * | 5/1983 | Loveless | 137/884 X |
| 4,642,025 | * | 2/1987 | Heiniger et al. | 415/139 |
| 5,063,661 | * | 11/1991 | Lindsay | 415/214.1 X |
| 5,333,995 | * | 8/1994 | Jacobs et al. | 415/209.2 |
| 5,509,782 | * | 4/1996 | Streeter | 415/213.1 |
| 5,760,593 | * | 6/1998 | Lawrence et al. | 324/662 |

FOREIGN PATENT DOCUMENTS

| | | |
|---|---|---|
| 666937A5 | 8/1931 | (CH) . |
| 665450A5 | 5/1988 | (CH) . |
| 927782 | 5/1955 | (DE) . |
| 1055549 | 4/1959 | (DE) . |
| 3617537 | 11/1987 | (DE) . |

* cited by examiner

*Primary Examiner*—John E. Ryznic
(74) *Attorney, Agent, or Firm*—Herbert L. Lerner; Laurence A. Greenberg; Werner H. Stemer

(57) ABSTRACT

A device for thermally insulating casing parts of a steam turbine contains a shim element that can be inserted into a bearing region of supporting bearings of the casing parts. The supporting bearings face one another and the shim element has a number of holes formed therein.

16 Claims, 3 Drawing Sheets

DEVICE FOR THERMALLY INSULATING A STEAM TURBINE CASING

CROSS-REFERENCE TO RELATED APPLICATION

This application is a continuation of copending International Application PCT/DE98/01104, filed Apr. 21, 1998, which designated the United States.

BACKGROUND OF THE INVENTION

Field of the Invention

The invention relates to a device for thermally insulating casing parts of a steam turbine, in particular between an inner casing and an outer casing of a steam turbine having a spiral inflow.

Published, Non-Prosecuted German Patent Application DE 36 17 537 A1, for example, discloses an inflow casing of a steam turbine having a spiral inflow. In this case, between two casing parts of the steam turbine, which are supported against one another or rest on one another, in particular in the region of a torque support or a supporting bearing of an inner casing in the outer casing, large forces of, for example, about 1000 to 2000 kN and large temperature differences between the outer casing and the inner casing normally occur. Thus a high torque is produced on the respective support or bearing lug on account of the high pressure of, for example, 60 bar of the steam flowing into the steam turbine. The force which is thus produced on the respective support may be about 150 tons at this steam pressure.

Specified in Published, Prosecuted German Patent Application No. 1 055 549 is a shim which is disposed in a region of a dividing flange of a turbine outer casing between the turbine outer casing and a supporting lug of the turbine inner casing, the supporting lug resting on the turbine outer casing. In this case, the shim is a pressure plate that has holes that limit supporting cross sections. The intended purpose of the pressure plate is to expressly prevent inadmissible stresses from occurring in the flange of the outer casing if play present in the cold state between the supporting lug of the inner casing and the flange of the outer casing is bridged as a result of pronounced thermal expansions.

This is achieved by holes in the pressure plate which ensure plastic deformation of the pressure plate and thus a reduction in the input of stress into the flange of the outer casing.

A steam turbine having a spiral inflow is specified in each case in Swiss Patents CH 665 450 A5 and CH 666 937 A5. In the region of the respective flanges of the outer casing, unspecified components are disposed between the outer casing and the inner casing.

SUMMARY OF THE INVENTION

It is accordingly an object of the invention to provide a device for thermally insulating a steam turbine casing which overcomes the above-mentioned disadvantages of the prior art devices of this general type, in which casing parts of the steam turbine are thermally insulated from each other including spiral inflow casing parts.

With the foregoing and other objects in view there is provided, in accordance with the invention, a device for thermally insulating casing parts of a steam turbine, the casing parts have supporting bearings facing one another and defining a bearing region there-between, the device includes a shim element to be inserted into the bearing region of the supporting bearings of the casing parts, the shim element has bearing surfaces facing the supporting bearings and has a reduced cross section between the bearing surfaces, the shim element serving to transmit forces between the casing parts when steam is admitted in the steam turbine.

Provided in this case is a shim element or an intermediate element of reduced cross section, which can be inserted into a bearing region between two supporting bearings or supporting surfaces, facing one another, of the casing parts.

The shim element serves to transmit force between the casing parts of the steam turbine, at least if steam is admitted to the steam turbine. It is likewise possible for the shim element to be additionally or alternatively made of a material that has a higher strength relative to the respective material of the casing parts at a temperature that is increased relative to room temperature. This is especially important in particular in steam turbines which are subjected to high pressures and temperatures above 500° C., in particular above 550 to 650° C.

The invention in this case is based on the idea that, on the one hand, a material reduction of the shim element down to the value of the admissible compressive stress or surface tension is possible within a shim element also serving to orient casing parts relative to one another, since the admissible compressive stress within the shim element is several times higher than the admissible surface pressure from the shim element to the casing parts. On the other hand, such a deliberate material reduction of the shim element appropriately configured with regard to the dimensions and the material brings about a reduction in the heat quantity flowing through the shim element, since this heat quantity is determined by the remaining cross section within the shim element. Thus insulation is produced as it were, in which case no novel materials have to be used for the casing parts of the steam turbine. At a high temperature of the steam flowing into the steam turbine, for example, 580° C., a large heat quantity could be transferred from the inner casing via the respective support into the outer casing. If the inner casing is made of a heat resistant cast steel and the outer casing is made of a ductile iron having a comparatively low admissible thermal strength of a maximum of 350° C., an inadmissibly high heat transfer from the inner casing to the outer casing is prevented by the shim element. The temperature differences between the inner casing and the outer casing may be about 200 to 300° K.

To reduce the cross section between the two bearing surfaces, the shim element preferably has cross-section-reducing apertures and/or cavities. Such cross-section-reducing apertures may be made in the shim element subsequently, for example by drilling, milling, laser-beam treatment and further suitable processes. In this case, the shim element may be of one-piece or multi-piece construction. In a multi-piece construction, the apertures or cavities may be formed by recesses, slots, hollows or the like in parts of the shim element to be joined to one another. In such a shim element consisting of a plurality of parts, each part preferably has recesses, in particular grooves, which, when the parts are joined together, form passages separated from one another by webs. Steam or a similar cooling medium for cooling the shim element may flow through such passages.

In an advantageous refinement, the shim element, which is expediently parallelepiped-shaped, has a number of through-holes disposed next to one another. These through-holes advantageously run parallel to the opposite bearing surfaces of the shim element and preferably transversely to its longitudinal direction. Flow may therefore occur through the through-holes in order to cool the shim element, e.g. by use of an additional cooling medium or solely by convection. This is also ensured when the through-holes run in the longitudinal direction of the shim element. This is expedient, for example, when flow through the shim element in the longitudinal direction is desired or necessary on account of the position or fitting position of the shim element.

The shim element, in particular a drilled shim element, is especially suitable for use in a spiral casing having two torque supports which are disposed opposite one another and are expediently formed from supporting lugs, facing one another, of the outer casing and the inner casing. In this case, the supporting lugs are integrally formed on the inside of the outer casing and respectively on the outside of the inner casing. The shim element may also be advantageously used as a feather key or as a shim for orienting the casing parts relative to one another.

Other features which are considered as characteristic for the invention are set forth in the appended claims.

Although the invention is illustrated and described herein as embodied in a device for thermally insulating a steam turbine casing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
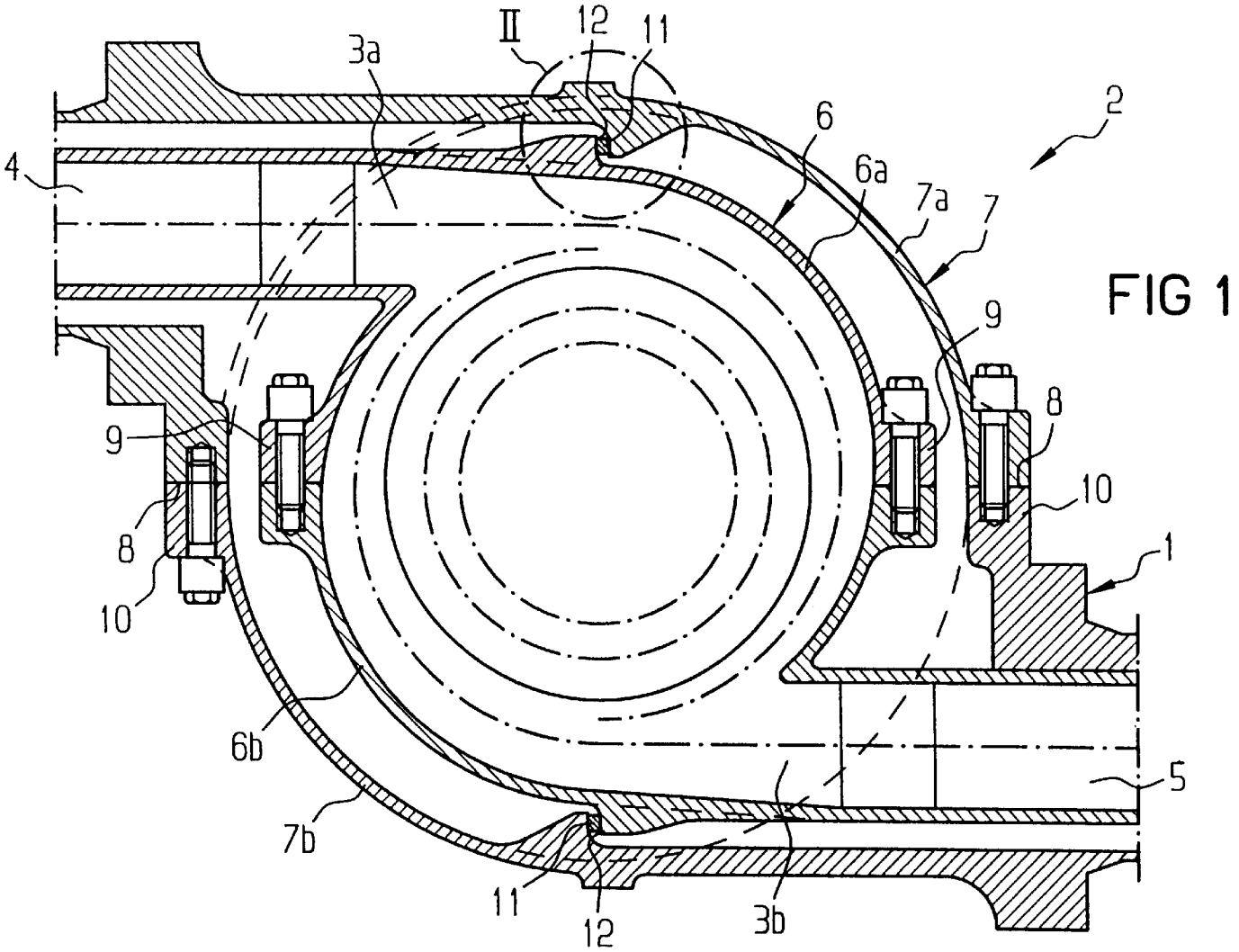
FIG. 1 is a diagrammatic, cross-sectional view through an inflow casing of a steam turbine having a spiral type of construction with two torque supports provided with shim elements.

In all the figures of the drawing, sub-features and integral parts that correspond to one another bear the same reference symbol in each case. Referring now to the figures of the drawing in detail and first, particularly, to FIG. 1 thereof, there is shown an inflow casing 1 of a steam turbine 2 with a spiral inflow having two flow ducts 3*a* and 3*b*. Each of the flow ducts 3*a*, 3*b* encloses approximately half of a turbine blade configuration and has an inlet 4 and 5 respectively. The inflow casing 1 is composed of an inner casing 6 forming the flow ducts 3*a*, 3*b* and of an outer casing 7 concentrically enclosing the inner casing 6. The inner casing 6 and the outer casing 7 are each composed of a casing top part 6*a*, 7*a* and a casing bottom part 6*b*, 7*b*, which are screwed to one another along the same parting line 8 by flange connections 9 and 10 respectively. The inner casing 6 is supported relative to the outer casing 7 via two torque supports 12 lying transversely opposite the parting line 8 and provided with shim elements 11.

Figure 2:
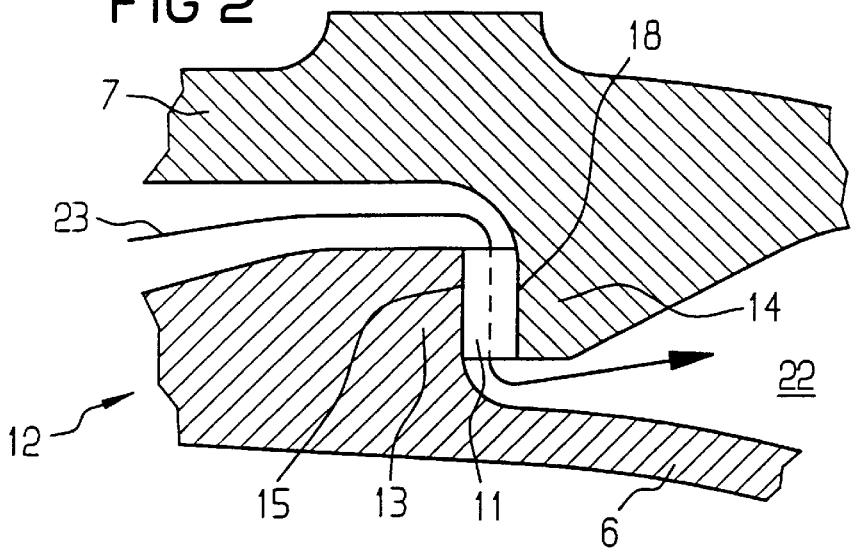
FIG. 2 is an enlarged, sectional view of a detail II shown in FIG. 1, with a shim element disposed between two supporting lugs.
Figure 3:
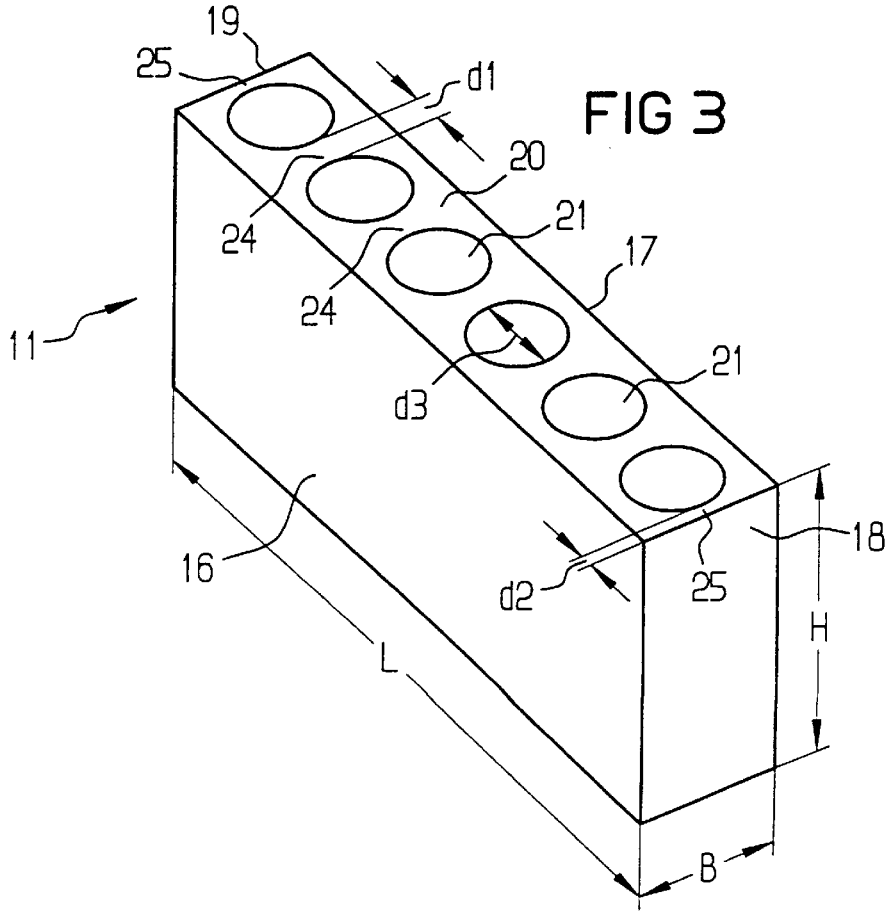
FIG. 3 is a perspective view of a drilled shim element.

FIG. 2 shows the torque support 12 having a supporting lug 13 integrally formed on the inner casing 6 on the outside and a supporting lug 14 integrally formed on the outer casing 7 on the inside. The supporting lugs 13, 14 form a supporting bearing for the inner casing 6 relative to the outer casing 7, which is located in a fixed position, so that a torque acting on the inner casing 6 during operation of the steam turbine 2 is directed via the outer casing 7 into a turbine fixing (not shown). A bearing region 15, in which the shim element 11 shown in FIG. 3 is disposed, is provided between the supporting lugs 13 and 14, which face one another at a distance apart.

The shim element 11 is a parallelepiped-shaped body of preferably heat-resistant steel, e.g. a high-alloy chrome-molybdenum-vanadium of the alloy $X_{22}CrMoV_{121}$. In the case of a steam turbine 2 configured for a steam temperature of 560 to 580° C. and a steam pressure of 180 bar (live-steam state) and having a total electrical output of 350 MW, a length L of the shim body 11 is about 240 mm. A width B of the shim element 11 is about 50 mm and a height H is about 100 mm. The shim element 11 has two opposite bearing surfaces 16, 17, which, when used in the bearing region 15, bear against the corresponding bearing surfaces of the supporting lugs 13 and 14 respectively. Furthermore, the shim element 11 has two opposite end faces 18, 19, of which the end face 18 is visible in FIG. 3. Furthermore, the shim element 11 likewise has opposite longitudinal surfaces, of which only a top longitudinal surface 20 is visible in FIG. 3.

The shim element 11 has six through-holes 21, which in the exemplary embodiment run parallel to the bearing surfaces 16, 17 and transversely to the longitudinal direction, i.e. so as to pass through the through flow surfaces 20. By such a configuration of the through-holes 21, a flow running along a flow line 23 can be set in an intermediate space 22 between the inner casing 6 and the outer casing 7 (see FIG. 2). Alternatively, the through-holes 21 may also run parallel to the longitudinal surface 20 and in the process pass through the end faces 18, 19.

The web width d1 between adjacent through-holes 21 is about 10 mm, whereas the web width d2 in the marginal region is in each case about 5 mm. In this case, the dimensions L, B, H in the case of the shim element 11 produced from chrome-molybdenum-vanadium with the alloy $X_{22}CrMoV_{121}$ are proportioned for an admissible surface pressure of 65 $N/mm^2$. A compressive stress of 300 to 400 $N/mm^2$ is then admissible within the material body, i.e. within the shim element 11. The number of through-holes 21 as well as their hole diameter d3 and the web widths d1, d2 are therefore proportioned in such a way that the remaining cross section in the intermediate webs 24 between the through-holes 21 and in the two marginal webs 25 is utilized up to the admissible compressive stress.

Only the webs 24, 25 are therefore available for a heat transfer from the inner casing 6 to the outer casing 7, so that the heat quantity flowing through the shim element 11 is correspondingly reduced compared with a solid material of the same size. In this case, the shim element 11 also serves to orient the inner casing 6 relative to the outer casing 7, in particular to compensate for play in the bearing region 15 between the two supporting lugs 13 and 14, the play being caused by production tolerances.

Figure 4:
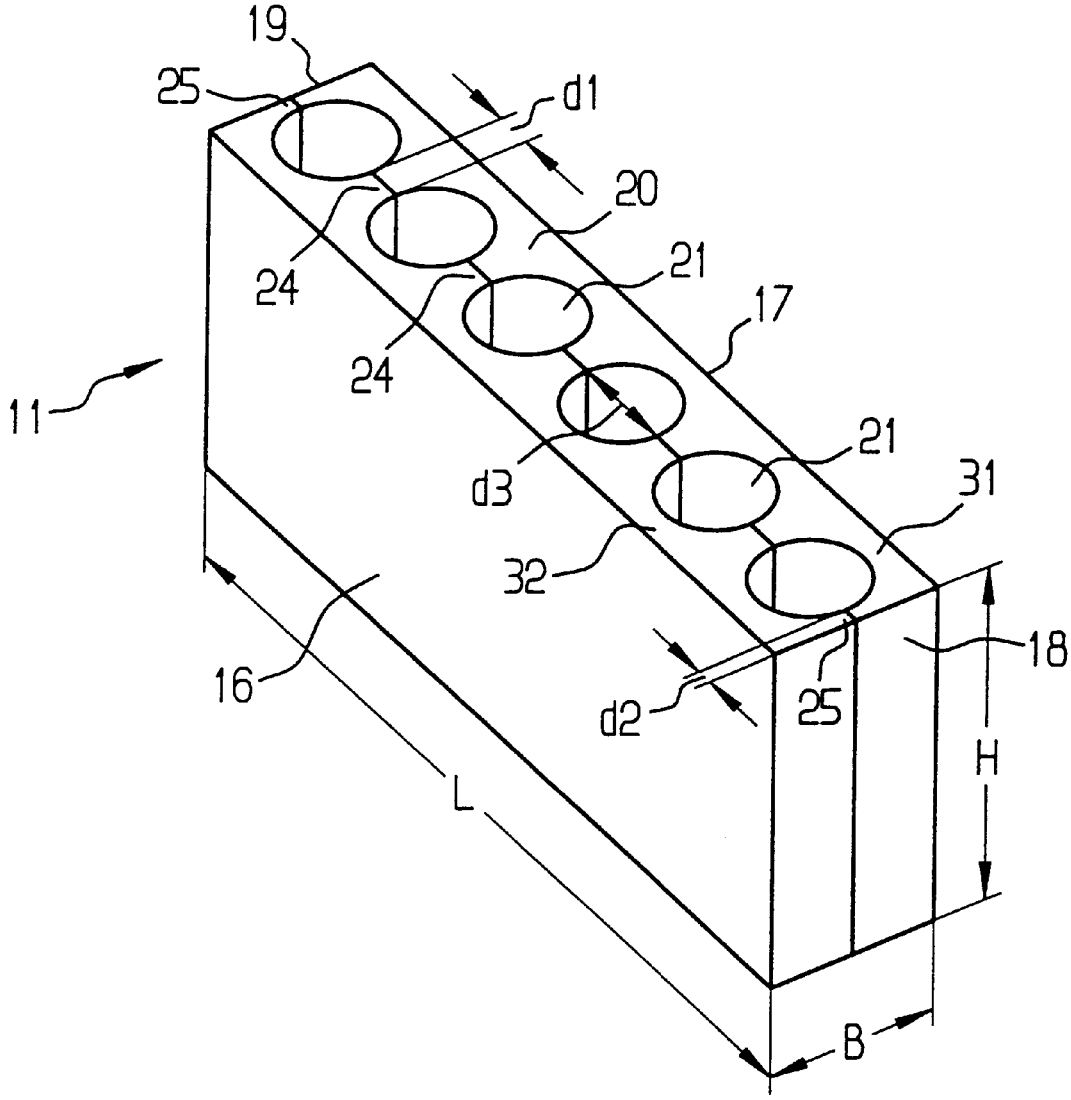
FIG. 4 is a perspective view of a two-piece shim element.

Shown in FIG. 4 in a perspective representation is the shim element 11 composed of two sectional elements 31 and 32. After the assembly of the two sectional elements 31 and 32, the shim element 11 corresponds in its configuration to the shim element 11 already described with respect to FIG.

3. With regard to effect and advantages, reference is therefore made to the description relating to FIG. 3. The sectional elements 31 and 32 each have channel-shaped recesses of semicircular cross section, so that, when the sectional elements 31 and 32 are assembled, passages having a circular cross section and a diameter d3 similar to the through-holes 21 are formed. It is likewise possible to additionally or alternatively make hemispherical or similar recesses in each sectional element 31 and 32, cavities, for example in spherical form, being formed by these hemispherical recesses when the sectional elements 31 and 32 are assembled. All of these configurations achieve a situation in which the cross-sectional area between the bearing surfaces 16 and 17 is reduced, so that a reduced cross section is available for a heat transfer through the shim element 11. The shim element 11 therefore thermally insulates the outer casing 7 relative to the inner casing of the steam turbine 2. If a cooling medium 23 is additionally passed through the through-holes 21, a further reduction in the heat transfer between the inner casing 6 and the outer casing 7 of the steam turbine is effected.

I claim:

1. An improved casing of a steam turbine having casing parts with supporting bearings facing one another and defining a bearing region therebetween, the improvement comprising:

a device for thermally insulating the casing parts of the casing, said device having a shim element inserted into the bearing region of the supporting bearings of the casing parts, said shim element having bearing surfaces facing the supporting bearings and having a reduced cross section between said bearing surfaces, said shim element serving to transmit forces between the casing parts when steam is admitted in the steam turbine.

2. The device according to claim 1, wherein said shim element has at least one of a number of cross-section-reducing apertures and cavities formed therein.

3. The device according to claim 2, wherein said cross-section-reducing apertures are holes.

4. The device according to claim 1, wherein said shim element has a plurality of through-holes formed therein disposed parallel to said bearing surfaces.

5. The device according to claim 1, wherein said shim element is made of a heat-resistant steel.

6. The device according to claim 5, wherein said heat-resistant steel is of an alloy formed of a composition of $X_{22}CrMoV_{121}$.

7. The device according to claim 4, wherein said shim element has ends, said plurality of through-holes defining webs between adjacent pairs of said plurality of through-holes and between one of said plurality of through-holes and one of said ends of said shim element, said webs configured for absorbing an admissible compressive stress on said shim element.

8. An improved casing of a steam turbine having casing parts with supporting bearings facing one another and defining a bearing region therebetween, the improvement comprising:

a device for thermally insulating the casing parts of the casing, said device having a shim element inserted into the bearing region of the supporting bearings of the casing parts, said shim element having bearing surfaces facing the supporting bearings and having a reduced cross section between said bearing surfaces, said shim element made of a material having a higher strength relative to a respective material of the casing parts at a temperature increased relative to room temperature.

9. The device according to claim 8, wherein said shim element has at least one of a number of cross-section-reducing apertures and cavities formed therein.

10. The device according to claim 9, wherein said cross-section-reducing apertures are holes.

11. The device according to claim 8, wherein said shim element has a plurality of through-holes formed therein disposed parallel to said bearing surfaces.

12. The device according to claim 8, wherein said shim element is made of a heat-resistant steel.

13. The device according to claim 12, wherein said heat-resistant steel is of an alloy formed of a composition of $X_{22}CrMoV_{121}$.

14. The device according to claim 11, wherein said shim element has ends, said plurality of through-holes defining webs between adjacent pairs of said plurality of through-holes and between one of said plurality of through-holes and one of said ends of said shim element, said webs configured for absorbing an admissible compressive stress on said shim element.

15. A casing of a steam turbine, comprising:

spirally shaped casing parts including an outer casing part having an outer supporting bearing and an inner casing part having an inner supporting bearing facing said outer supporting bearing, said outer supporting bearing and said inner supporting bearing defining a bearing region therebetween; and a shim element disposed in said bearing region and having bearing surfaces facing said inner supporting bearing and said outer supporting bearing, said shim element having a reduced cross section between said bearing surfaces and serving to transmit forces between said casing parts when steam is admitted in the steam turbine.

16. The casing according to claim 15, wherein said outer supporting bearing and said inner supporting bearing each has an integrally formed supporting lug.

* * * * *